US008576266B2

(12) United States Patent
Giese

(10) Patent No.: US 8,576,266 B2
(45) Date of Patent: Nov. 5, 2013

(54) IMAGING APPARATUS WITH MOVEABLE MEDIA GUIDE

(75) Inventor: Troy A. Giese, Blaine, MN (US)

(73) Assignee: Carestream Health, Inc., Rochester, NY (US)

( * ) Notice: Subject to any disclaimer, the term of this patent is extended or adjusted under 35 U.S.C. 154(b) by 312 days.

(21) Appl. No.: 13/155,831

(22) Filed: Jun. 8, 2011

(65) Prior Publication Data

US 2012/0127255 A1 May 24, 2012

Related U.S. Application Data

(60) Provisional application No. 61/416,834, filed on Nov. 24, 2010.

(51) Int. Cl.
*B41J 17/28* (2006.01)

(52) U.S. Cl.
USPC ..... 347/215

(58) Field of Classification Search
USPC ..... 347/171–176, 215, 217
See application file for complete search history.

(56) References Cited

U.S. PATENT DOCUMENTS

| | | | | |
|---|---|---|---|---|
| 3,789,571 | A | 2/1974 | Tall et al. | |
| 4,910,602 | A * | 3/1990 | Sakuragi | 347/215 |
| 5,392,092 | A | 2/1995 | Laidlaw et al. | |
| 5,564,847 | A | 10/1996 | Patrick et al. | |
| 6,341,835 | B1 * | 1/2002 | Ogawa et al. | 347/215 |
| 6,942,406 | B2 | 9/2005 | Sunada et al. | |
| 8,042,931 | B2 * | 10/2011 | Hiroki et al. | 347/215 |
| 2005/0083395 | A1 * | 4/2005 | Kubota et al. | 347/215 |
| 2008/0036297 | A1 | 2/2008 | Gilbertson | |
| 2010/0220170 | A1 * | 9/2010 | Mori | 347/215 |

FOREIGN PATENT DOCUMENTS

WO 2008042273 4/2008

* cited by examiner

*Primary Examiner* — Kristal Feggins

(57) ABSTRACT

An imaging apparatus including a media supply, a transport path, a supply path for transporting sheets of photothermographic imaging media from the media supply to the transport path, a drive roller driving sheets of imaging media along the supply path, and a media guide moveable from a normally closed position to an open position to provide a continuous surface for moving a sheet of imaging media from the supply path onto the transport path in a first direction along the transport path, and wherein the media guide is moveable from the open position to the normally closed position upon the entire sheet of imaging media being moved onto the transport path to block the sheet of imaging media from entering the supply path when moving along the transport path in a direction opposite the first direction.

20 Claims, 12 Drawing Sheets

IMAGING APPARATUS WITH MOVEABLE MEDIA GUIDE

CROSS REFERENCE TO RELATED APPLICATIONS

Priority is claimed to Provisional U.S. Patent Application Ser. No. 61/416,834, entitled "TRANSPORT SYSTEM HAVING A FILM DIVERTER" by Troy A. Giese, filed Nov. 24, 2010, the disclosure of which is incorporated herein by reference.

FIELD OF THE INVENTION

The invention relates generally to the field of imaging, and in particular to a laser imaging apparatus. More specifically, the invention relates to a laser imaging apparatus with a feeder assembly enabling exposure of a sheet of photothermographic imaging media while the feeder assembly is providing the sheet to an exposure system.

BACKGROUND OF THE INVENTION

Laser imagers are widely used to produce visual representations of images on film, such as light sensitive photothermographic film, for example. Laser imagers are used in a variety of applications ranging from standard photography and graphic arts applications to medical applications where they are used to produce visual representations on film of digital image date generated by magnetic resonance (MR), computed tomography (CT), and other types of scanners.

Laser imagers typical include a media supply system, a feeder system, a feeder system, an exposure system, a processing system, an output system (e.g. output tray, sorter), and a transport system that moves film through the laser imager along a transport path through the exposure and processing systems to the output system. The media supply system generally includes a supply of sheets of photothermographic media stacked in one or more cassettes or trays and a pickup assembly for removing individual sheets from the cassettes for delivery to the feeder assembly.

Laser imagers often segregate the functions of extracting a film sheet from the media supply system, exposing or imaging the extracted sheet, and processing or developing the exposed sheet. However, in order to provide faster time-to-first-image and so as to provide increased film throughput, some laser imaging systems perform some such operations concurrently in an overlapping fashion. For example, some laser imagers begin processing or developing the film sheet while it is still being exposed, a so-called processing-while-imaging system. Other imagers begin exposing the film sheet while the sheet is stilling being supplied to the exposure system by the media supply and feeder systems. In such cases, it is important to avoid sheet disturbances associated with transfer of the film sheet from the feeder and media supply systems to the exposure system, as such disturbances can propagate through the film sheet and create defects in the exposed image on the film sheet.

While such systems may have achieved certain degrees of success in their particular applications, there is a need to provide an improved system and method for transferring film sheets from feeder and media supply systems to an exposure system which is simultaneously exposing the film sheet in laser imaging systems employing photothermographic imaging media.

SUMMARY OF THE INVENTION

An object of the present invention is to provide a mechanism for transferring a sheet of imaging media from supply path to a transport path which eliminates disturbances to the sheet as is transitions from the supply path to the transport path which might otherwise cause errors in an image exposed on the sheet.

Another object of the present invention is to eliminate the potential for misfeeding sheets of imaging media from the transport path onto the supply path.

These objects are given only by way of illustrative example, and such objects may be exemplary of one or more embodiments of the invention. Other desirable objectives and advantages inherently achieved by the disclosed invention may occur or become apparent to those skilled in the art. The invention is defined by the appended claims.

According to one aspect of the invention, there is provided an imaging apparatus including a media supply, a transport path, a supply path for transporting sheets of photothermographic imaging media from the media supply to the transport path, a drive roller driving sheets of photothermographic imaging media along the supply path, and a moveable media guide positioned at a junction of the supply path with the transport path. The moveable media guide is moved from a normally closed position to an open position to provide a continuous surface for moving a sheet of photothermographic imaging media from the supply path onto the transport path in a first direction along the transport path, and wherein the moveable media guide is moved from the open position to the normally closed position upon the entire sheet of photothermographic imaging media being moved onto the transport path to block the sheet of photothermographic imaging media from entering the supply path when moving along the transport path in a direction opposite the first direction.

According to one aspect of the invention, the moveable media guide is moved to and held in the open position by force of the sheet of photothermographic imaging media being driven along and passing from the supply path to the transport path, and wherein the moveable media guide returns to the normally closed position by the force of gravity upon a trailing edge of the sheet of photothermographic imaging media passing from the moveable media guide onto the transport path.

According to one aspect of the invention, the moveable media guide comprises a plurality of elongated paddles, each paddle separately mounted to and independently rotatable about a stationary shaft, wherein the elongated paddles hang from the shaft by gravity in the normally closed position, and wherein the elongated paddles rotate about the shaft to the open position.

According to one aspect of the invention, the elongated paddles are spaced apart from one another along the shaft so as to provide support for a plurality of widths of sheets of photothermographic imaging media.

According to one aspect of the invention, there is provided a method for transporting film in an imaging apparatus, the method including positioning a moveable media guide at a junction of a supply path with a transport path, driving a sheet of film from a media source along the supply path to the transport path, moving the media guide from a normally closed position to an open position to provide an continuous surface for moving the sheet of film from the supply path onto the transport path in a first direction along the transport path, and moving media guide from the open position to the normally closed position upon the entire sheet of photothermographic imaging media being moved onto the transport path to block the sheet of photothermographic imaging media from entering the supply path when moving along the transport path in a direction opposite the first direction.

According to one aspect of the invention, the method includes moving the media guide to the open position by pushing the media guide to the open position by force of the sheet being driven along the supply path to the transport path, and moving the media guide to the closed position comprising returning the media guide to the closed position by gravity after a trailing edge of the sheet passes from the media guide to the transport path.

According to one aspect of the invention, there is provided an imaging apparatus including a transport path, a supply path transporting sheets of media from a media supply to the transport path, and a media guide disposed at a junction of the supply path with the media path and moveable between a normally closed position and an open position, wherein the media guide, when in the open position, provides a continuous surface for supporting a sheet of media being transported along the supply path and being transferred from the supply path onto the transport path in a first direction along the transport path, and when in the closed position, blocks the sheet of media from entering the supply path when being transported along the transport path in a direction opposite the first direction.

According to one aspect of the invention, the media guide is pushed from the normally closed position to the open position by the sheet of media as it is driven along the supply path to the transport path, and wherein the media guide returns to the normally closed position by gravity upon a trailing edge of the sheet of media moves from the media guide to the transport path.

By using a moveable media guide, the moveable media guide provides continuous support to the sheet of media and prevents a "whip-like" effect of a trailing edge of the sheet of media when transitioning from the supply path to the transport path and thereby eliminates a force that would otherwise be imparted to sheet of media which would propagate through the sheet and cause an error in a latent image being exposed on the sheet by the imaging apparatus. Additionally, by returning to a normally closed position after the sheet of media has transitioned to the transport path from the supply path, the moveable media guide prevents misfeeds of the sheet of media from the transport path to the supply path. Furthermore, by using the sheet of media to push the moveable media guide from the normally closed position to the open position and using gravity to return the moveable media guide to the normally closed position, the need for additional components to drive the moveable media guide between the normally closed and open positions can be eliminated.

BRIEF DESCRIPTION OF THE DRAWINGS

The foregoing and other objects, features, and advantages of the invention will be apparent from the following more particular description of the embodiments of the invention, as illustrated in the accompanying drawings. The elements of the drawings are not necessarily to scale relative to each other.

DETAILED DESCRIPTION OF THE INVENTION

Figure 1:
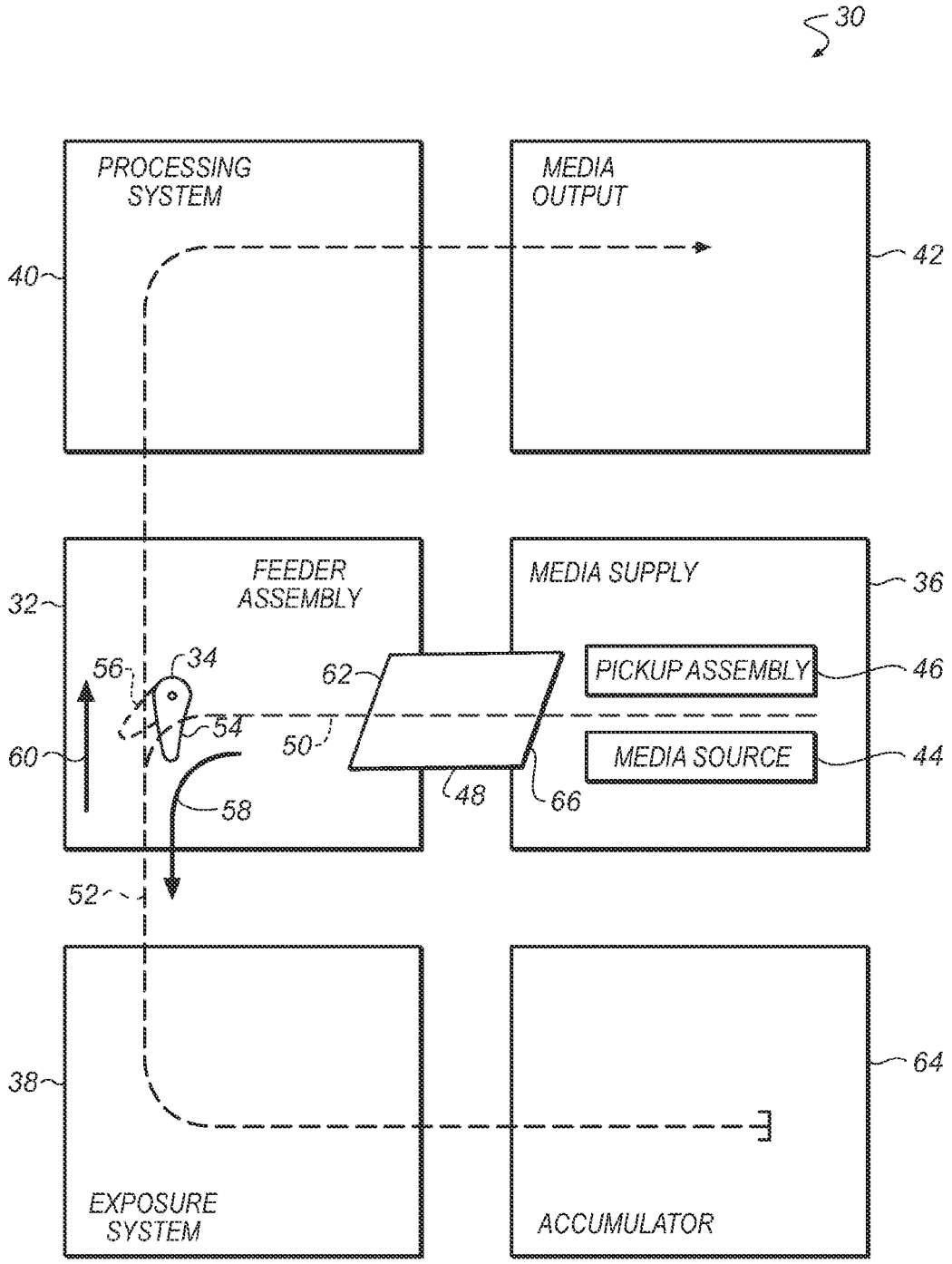
FIG. 1 shows a block diagram generally illustrating an example of an imaging apparatus employing a feeder assembly according to the present disclosure.

The following is a detailed description of the preferred embodiments of the invention, reference being made to drawings in which the same reference numerals identify the same elements of structure in each of the several figures.

FIG. 1 is a block diagram illustrating generally an example of an imaging apparatus 30 including a feeder assembly 32 employing a moveable media guide 34, according to embodiments of the present disclosure, which, as will be described in greater detail below, reduces and/or eliminates potential disturbances in a sheet of photothermographic imaging media as the sheet or film is being transferred to and simultaneously imaged by an exposure system. In addition to feeder assembly 32, imaging apparatus 30 includes a media supply system 36, an exposure system 38, a processing system 40, and a media output system 42. According to one embodiment, media supply system 36 further includes a media source 44 and a pickup assembly 46. In one embodiment, media source 44 comprises a media cassette 44 containing a stack of sheets of unexposed photothermographic imaging media.

In operation, pickup assembly 46 is configured to remove an individual sheet of photothermographic imaging media, such as sheet 48, from media cassette 44. Feeder assembly 32 is configured to engage a leading edge of sheet 48 from pickup assembly 46 and begin driving or moving sheet 48 along a supply path 50 to a transport path 52. Moveable media guide 34 is positioned at a junction of supply path 50 with transport path 52. Moveable media guide 34 is in a normally closed position 54 (as illustrated by the solid lines in FIG. 1) where it blocks the transfer of film sheets between supply path 50 and transport path 52, and is moveable to an open position 56 (as illustrated by the dashed lines in FIG. 1) where it enables the passage of film between supply path 50 and transport path 52. According to one embodiment, moveable media guide 34 is a one-way film guide which allows movement of sheet 48 from supply path 50 to transport path 52 in a direction as illustrated by directional arrow 58 when in open position 56, but blocks movement of sheet 48 from transport path 52 to supply path 50 when in closed position 54 and allows movement of sheet 48 only along transport path 52 past the junction with supply path 50 as indicated by directional arrow 60.

According to one embodiment, moveable media guide 34 is held in normally closed position 54 by gravity. According to one embodiment, media guide 34 is configured so as to have a center of gravity and a mass which cause media guide 34 to hang by gravity in the normally closed position. As feeder assembly 32 drives sheet 48 along supply path 50, a leading edge of sheet 48 contacts and pushes moveable media guide 34 to open position 56, and as feeder assembly 32 continues to drive sheet 48, moveable media guide 34 directs sheet 48 onto transport path 52 in a direction as indicated by directional arrow 58. Feeder assembly 32 continues to drive sheet 48 along transport path 52, wherein is engaged by and begins to have a latent image of a desired image (e.g. digital MR image) exposed thereon by exposure system 38. According to one embodiment, exposure system 38 includes a laser exposure unit which exposes the latent image on sheet 48 via modulation of a laser scanning module based on the image data.

Exposure system 38 feeds the exposed or imaged portion of sheet 48 along transport path 52 to a sheet accumulator 64. As sheet 48 continues to be fed along transport path 52 and is imaged by exposure system 38, a trailing edge 66 of sheet 48 moves along supply path 50 and is guided onto transport path 52 by moveable media guide 34. When trailing edge 66 of sheet 48 passes moveable media guide 34, moveable media guide 34 moves back to normally closed position 54 by the force of gravity. According to one embodiment, the mass and center of gravity of media guide 34 are selected so as to provide a slow transition from the open position to the normally closed position so that media guide 34 does not "slam shut" into the normally closed position and thereby avoid transferring potential vibrations to sheet 48 that could cause artifacts in the latent image.

Once exposure system 38 completes exposure of the latent image onto sheet 48, exposure system 38 reverses direction and begins moving or driving the now-exposed sheet 48 along transport path 52 toward processing system 40 such that formerly trailing edge 66 now becomes the leading edge. As the now leading edge 66 of sheet 48 approaches the junction of transport path 52 with supply path 50, moveable media guide 34, which is now in the closed position, blocks sheet 48 from inadvertently entering supply path 50 and directs sheet 48 along transport path 52 toward processing system 40 as indicated by directional arrow 60.

Processing system 40 receives and engages exposed sheet 48 from exposure system 38 via transport path 52 and develops the latent image formed thereon by exposure system 38. In one embodiment, processing system 40 comprises a thermal processor (e.g. a drum-type processor, drum and flatbed type) which heats exposed sheet 48 to thermally develop the latent image. According to one embodiment, the developed sheet 48 is cooled and moved by processing system 40 to media output system 42 (e.g. a tray). The above described process is repeated for each subsequent sheet.

According to one embodiment, in lieu of being gravity operated, moveable media guide 34 is driven by a motor which is activated by sensors (e.g. optical sensor, position switches) positioned at appropriate locations along supply and transport paths 50 and 52 to detect the presence of leading and trailing edges 62 and 66 of sheet 48. In addition to blocking the inadvertent movement of exposed sheet 48 from transport path 52 to supply path 50, moveable media guide 34 provides an uninterrupted surface which continuously supports trailing edge 66 of sheet 48 as it is transferred from supply path 50 to transport path 52. The continuous support of trailing edge 66 provided by moveable media guide 34 prevents a so-called "flip" or "snap" of trailing edge 66 from supply path 50 to transport path 52 which would otherwise occur in the absence of moveable media guide 34 and which would cause a sheet disturbance that would propagate through sheet 48 and cause an artifact or distortion in the latent image as it is being exposed on sheet 48 by exposure system 38. As such, moveable media guide 34 of feeder assembly 32 is configured to deliver sheet 48 to exposure system 38 in a fashion to substantially minimize disturbances to sheet 48 to enable exposure system 38 to begin exposing a desired image on sheet 48 while a portion of sheet 48 is still being transferred to exposure system 38 from feeder assembly 32.

Figure 2:
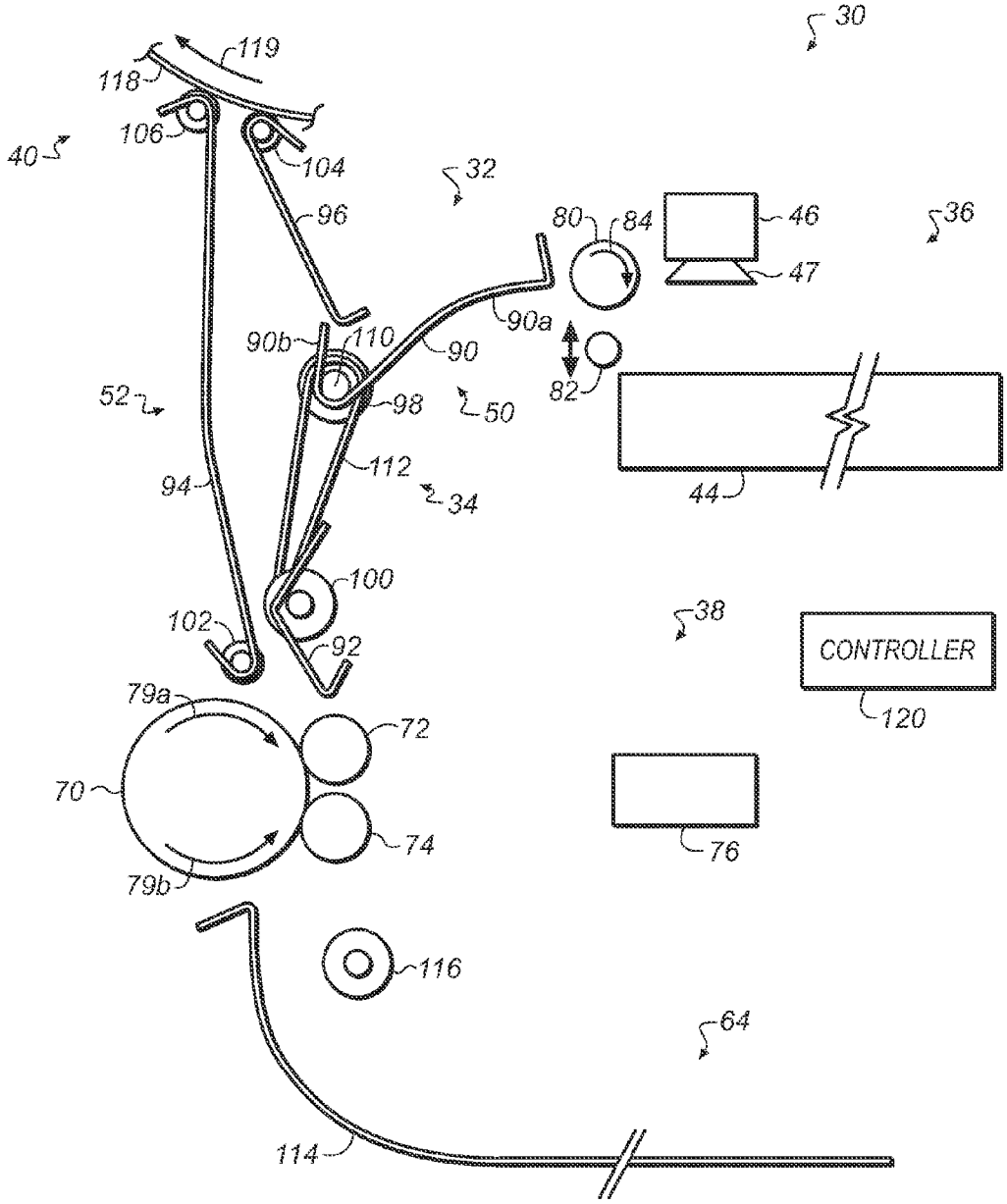
FIG. 2 shows a block and schematic diagram of an imaging apparatus employing a feeder assembly according to one embodiment.

FIG. 2 is a block and schematic diagram illustrating portions of imaging apparatus 30 including feeder assembly 32, including one embodiment of moveable media guide 34 according to the present disclosure, media supply system 36, exposure system 38, processing system 40, media output system 42, and accumulator 64. Media supply system 36 includes a media source, 44 such as a media cassette 44, containing a stack of sheets of photothermographic imaging media, and pickup assembly 46 which, according to one embodiment, includes a moveable suction cup assembly 47.

Figure 5A:
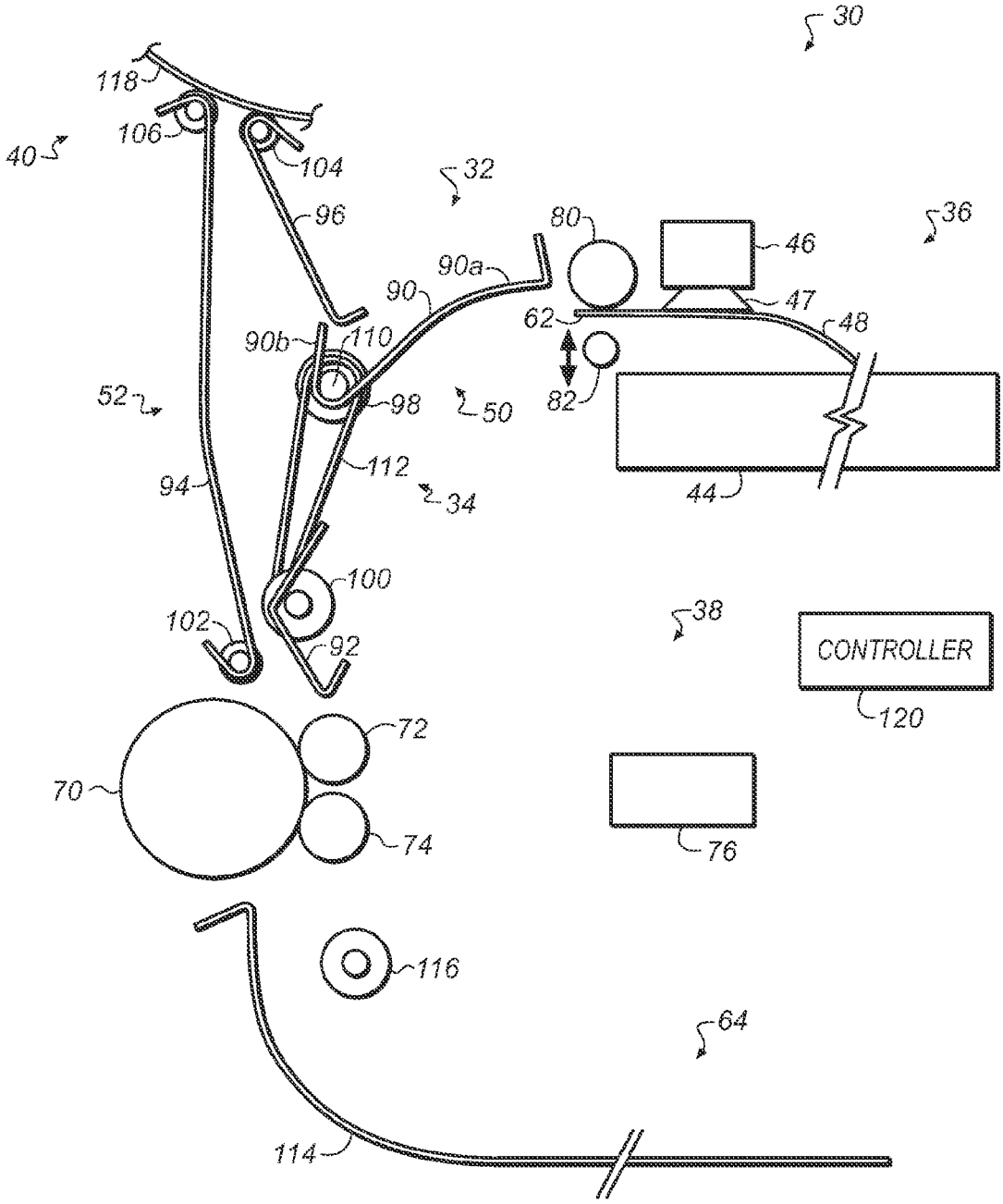
FIGS. 5A-5H show block and schematic diagrams illustrating an example of the operation of the imaging apparatus and feeder assembly of FIG. 2.
Figure 5B:
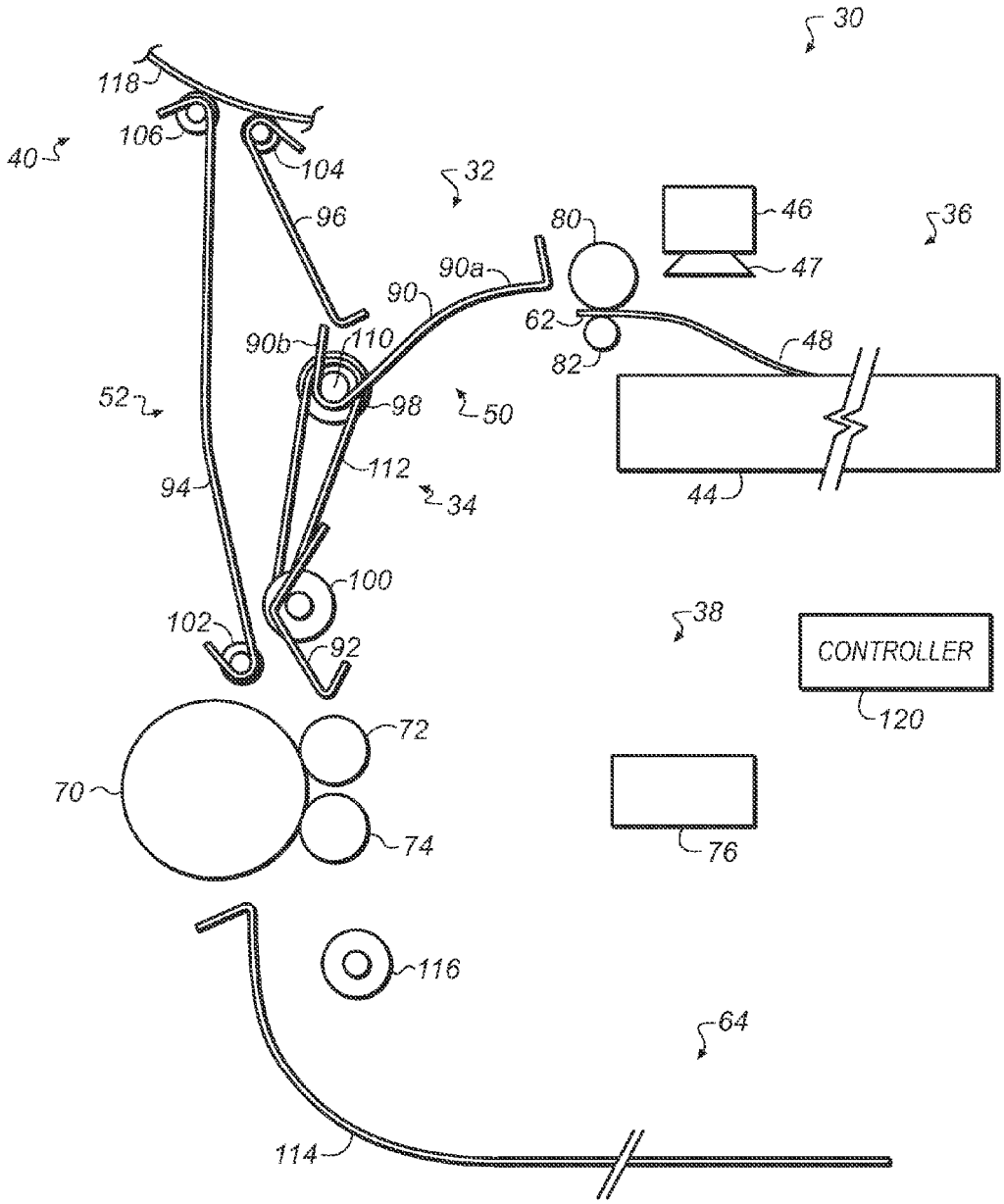
Figure 5C:
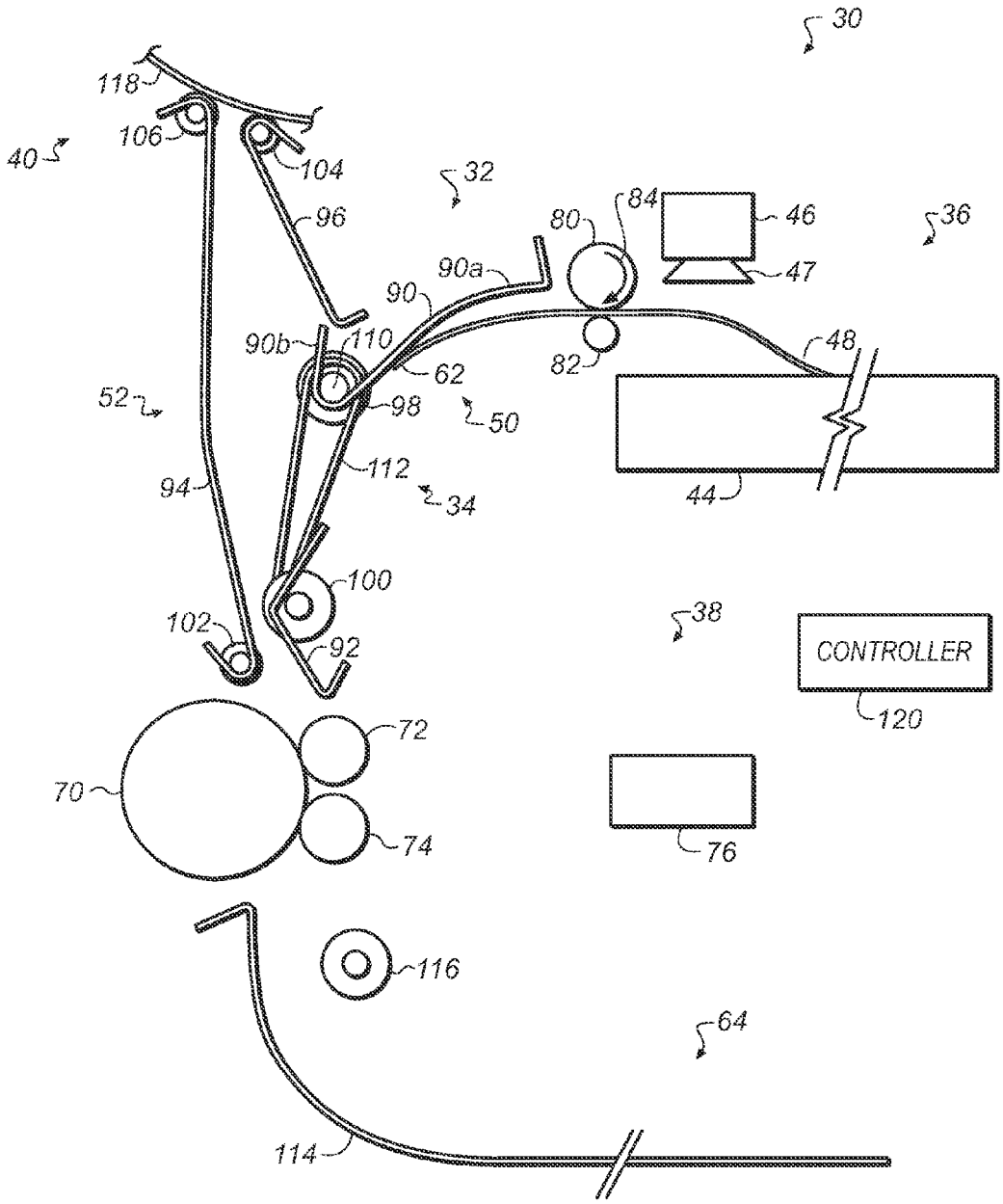
Figure 5D:
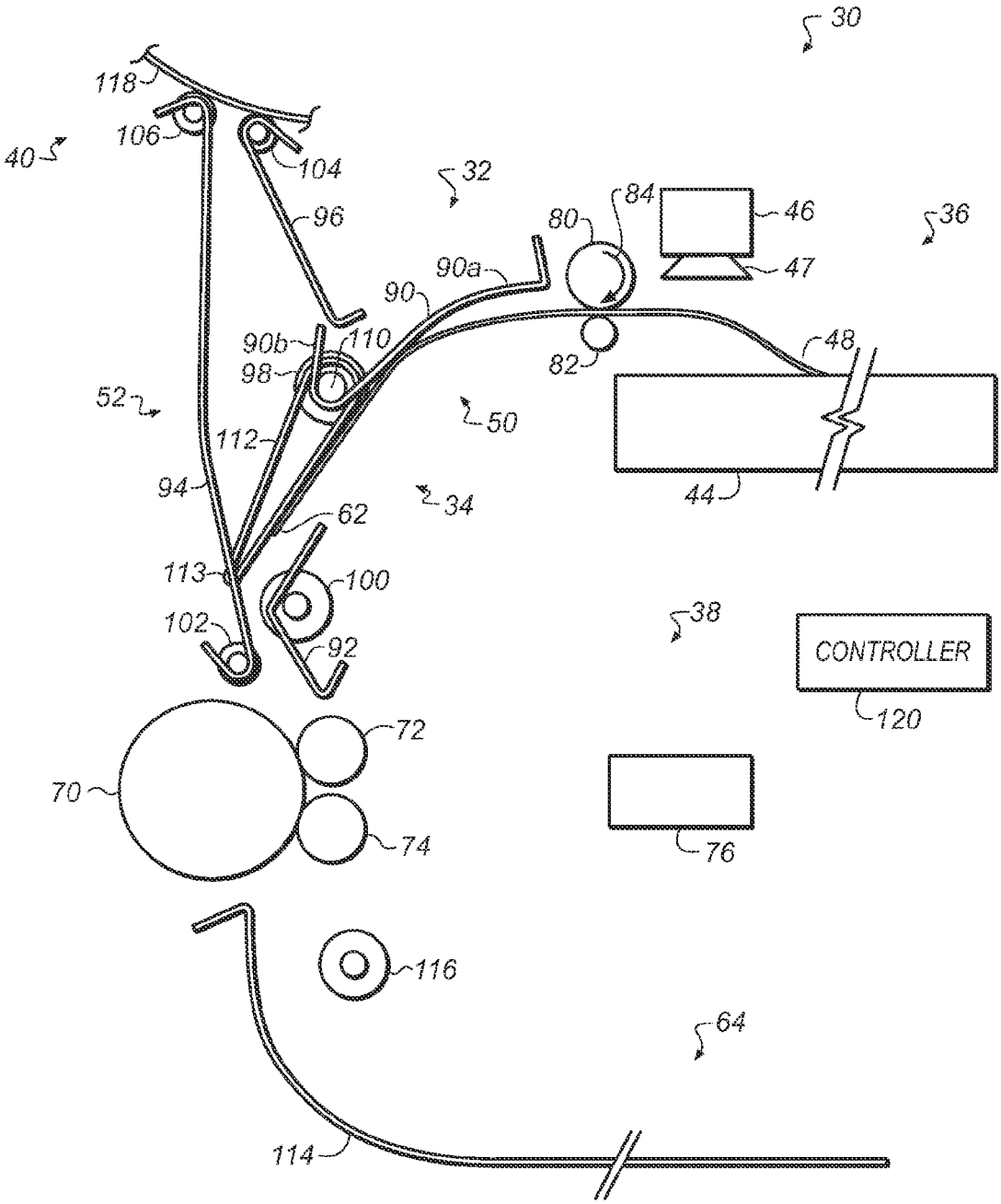
Figure 5E:
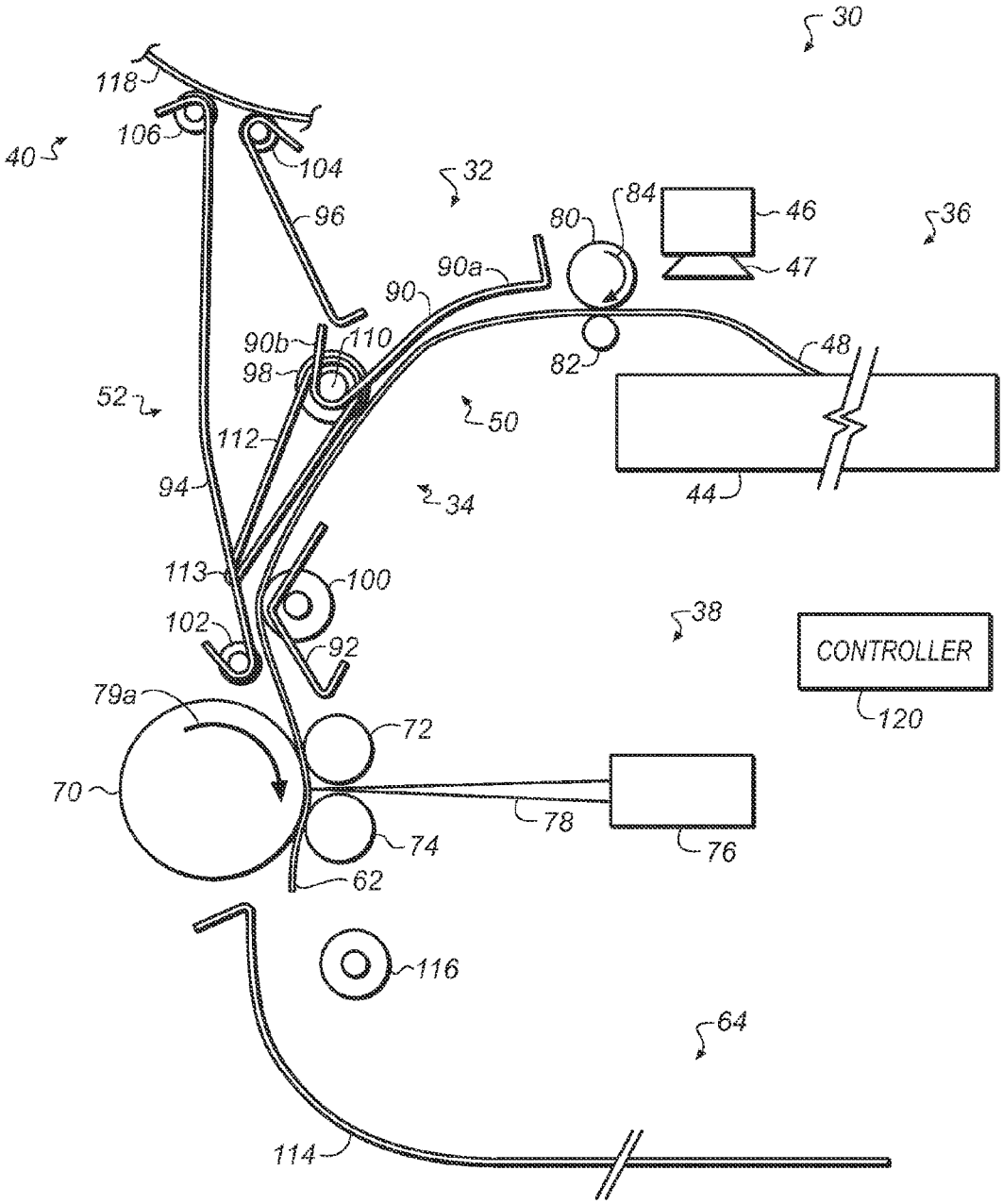

According to one embodiment, exposure system 38 is a laser exposure system 38 including a rotating exposure roller 70, first and second pressure rollers 72 and 74, each of which is biased against exposure roller 70, and a laser scanning module 76 that provides a light beam 78 which is modulated based on image data (e.g. digital or analog) to form a latent image of a desired photographic image on sheet of photothermographic imaging media, such as sheet 48, as it passes between and is held against exposure roller 70 by first and second pressure rollers 72 and 74 (see FIG. 5E). Exposure roller 70 can be driven in a first direction, as indicated by directional arrow 79*a*, to drive a sheet of imaging media toward past laser scanning module 76 toward accumulator 64, and in a second direction, as indicated by directional arrow 79*b*, to drive a sheet of imaging media toward processing system 40.

Feeder assembly 32, in addition to moveable media guide 34, includes a drive roller 80 and an idler roller 82, with idler roller 82 being moveable between a "closed" position and an "open" position, with moveable idler roller 82 being illustrated in the closed position in FIG. 2. When in the closed position, moveable idler roller 82 forms a nip with drive roller 80, and drive roller 80 is driven in a direction as indicated by directional arrow 84 to drive a sheet of imaging media from media supply system 36 to exposure system 38 (see FIG. 5B).

Feeder assembly 32 further includes stationary guide plates 90, 92, 94, and 96, and stationary idler wheels 98, 100, 102, 104, and 106. In one embodiment, stationary idler wheels 98, 100, 102, 104, and 106 comprise idler wheel assemblies including a plurality of low-inertia idler wheels spaced along and able to independently rotate about a shaft. For example, stationary idler wheels 98 are positioned on and able to independently rotate about a shaft 110. An example of an idler wheel assembly suitable for use as the above described idler wheel assemblies is described by U.S. Patent Application Publication No. 2008/0036297, entitled "IMAGING APPARATUS WITH TRANSPORT SYSTEM EMPLOYING SNAP-ON IDLER WHEEL", incorporated herein by reference.

Guide plate 90 has a first or leading end 90*a* positioned proximate to and configured to receive a sheet of photothermographic imaging media from rollers 80 and 82. Guide plate 90 is curved so as to direct a sheet of photothermographic imaging media from media cassette 44 toward moveable media guide 34 and exposure system 38.

According to one embodiment, moveable media guide 34 is positioned at a second or trailing end 90*b* and, as will be describe below, is configured to direct and transfer a sheet of imaging media from guide plate 90 to guide plate 94 and on to exposure system 38. According to one embodiment, moveable media guide 34 comprises a plurality of elongated paddles 112 which are mounted on and independently moveable about shaft 110 on which stationary idler rollers are mounted (see FIG. 4). As described above, paddles 112 are moveable between a normally closed position and an open position, and which are maintained at the normally closed position by the force of gravity. Paddles 112 are shown in the normally closed position in FIG. 2.

According to one embodiment, it is noted that together, guide plate 90, idler wheels 98, and paddles 112 of moveable media guide 34 form supply path 50, and that, together, guide plates 92, 94, 96, idler wheels 100, 102, 104, 106, and paddles 112 of moveable media guide 34 form transport path 52. It is further noted that paddles 112 (i.e. opposing sides thereof) form portions of both supply path 50 and transport path 52.

According to one embodiment, as illustrated, transport path 52 is substantially vertical and supply path 50 is off-vertical.

Accumulator 64 includes a guide plate 114 an idler wheels 116. Processing system 40 includes a rotating heated drum 118 which rotates in a direction 119 to draw in and thermally develop a sheet of imaging media from guide plates 94 and 96. A controller 120 is configured to control the operation of feeder assembly 32, media supply system 36, exposure system 38, processing system 40, and any number of other processes and components associated with the operation of imaging apparatus 30.

Figure 3:
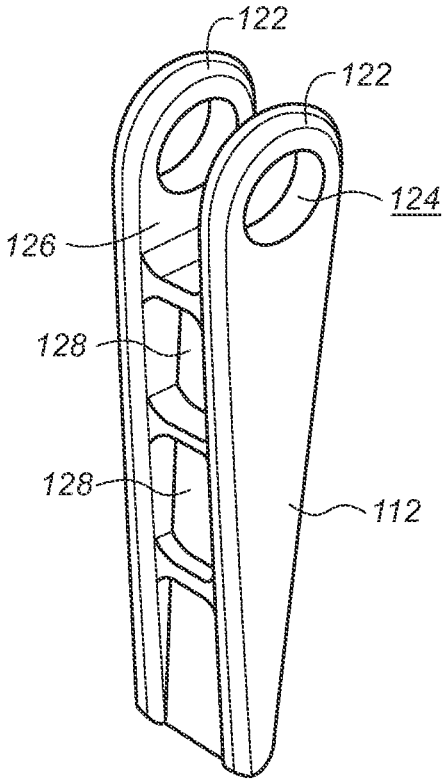
FIG. 3 is a diagram illustrating portions of a moveable media guide according to one embodiment.

FIG. 3 is a perspective view illustrating one embodiment of a paddle 112 of moveable media guide 34. According to one embodiment, paddle 112 includes a pair of flanges 122 with a pair of apertures 124 extending there through, and with flanges 122 forming a recess 126 there between. According to one embodiment, openings 128 extend through paddle 112 in order to provide proper wall thickness for injection molding processes. According to one embodiment, paddle 112 comprises a contiguous piece of material. According to one embodiment, paddle 112 is formed of plastic. According to one embodiment, paddle 112 is formed using a material having low-static properties. According to one embodiment, paddle 112 is formed of an anti-static acetal material. According to one embodiment, paddle 112 is formed of Delrin®.

Figure 4:
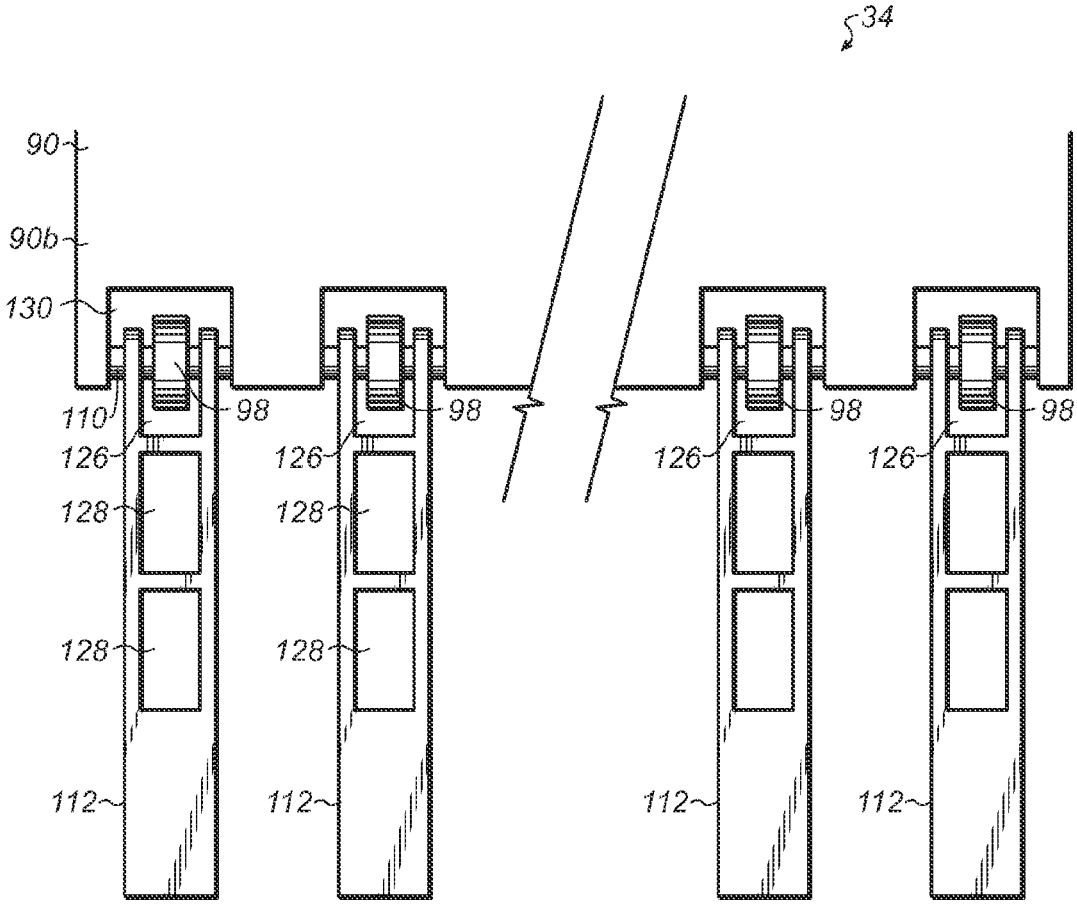
FIG. 4 is a diagram illustrating a moveable media guide according to one embodiment.

FIG. 4 illustrates an example of moveable media guide 34 according to one embodiment. Shaft 110 extends across a width of trailing edge 90*b* of guide plate 90. Idler wheels 98 are positioned on shaft 110 within cutouts 130 along trailing edge 90*b* of guide plate 90. Paddles 112 are positioned on shaft 110 within cutouts 130 with shaft 110 extending through apertures 124 (see FIG. 3) and with flanges 122 (see FIG. 3) on each side of idler wheels 98, such that idler wheels 98 are positioned within recesses 126 of paddles 112. According to one embodiment, as illustrated, paddles 112 are spaced apart from one another along shaft 110 in order to provide support for a plurality of widths of sheets of photothermographic imaging media.

According to one embodiment, each paddle 112 is independently rotatable about shaft 110. According to one embodiment (not illustrated), paddles 112 are fixed to shaft 110, while idler wheels 98 are able to independently rotate about shaft 110, and a motor drives shaft 110 to simultaneously rotate between the closed and open positions 54 and 56 (see FIG. 1). According to one embodiment (not illustrated), in lieu of individual paddles 112, a single monolithic paddle extending across a width of trailing edge 90*b* of guide plate 90 is employed. It is noted that the center of gravity and mass of paddles 112 are configured such that paddles 112 remain in the closed position until sheet 48 pushes them to the open position, as will described in greater detail below (see FIG. 5D).

FIGS. 5A through 5H illustrate an example of the operation of imaging apparatus 30 and feeder assembly 32 and, in particular, moveable media guide 34, according to one embodiment.

Initially, as illustrated by FIG. 5A, drive roller 80 of feeder assembly 32 is not driven and moveable idler roller 82 is in the open position such that the nip between drive roller 80 and moveable idler roller 82 is open. Pickup assembly 46, via suction cup assembly 47, engages and removes a top sheet of photothermographic imaging media, such as sheet 48, from media cassette 44 and positions leading edge 62 of sheet 48 in the open nip between drive roller 80 and idler roller 82. With reference to FIG. 5B, moveable idler roller 82 is moved to the closed position so as to close the nip with drive roller 80 to secure the leading edge 62 of sheet 48 therein. Sheet 48 is then disengaged by pickup assembly 46. It is noted that paddles 112 of moveable media guide 34 are in the normally closed position, via the force of gravity, in FIGS. 5A and 5B.

Referring to FIG. 5C, after leading edge 62 of sheet 48 is secured by drive roller 80 and idler roller 82, drive roller 80 is driven (as indicated by directional arrow 84) and drive and idler rollers 80, 82 begin pulling sheet 48 from media cassette 44 and feeding leading edge 62 toward guide plate 90. As sheet 48 is pulled from media cassette 44, leading edge 62 contacts and begins following guide plate 90 and is driven toward exposure system 38.

With reference to FIG. 5D, as drive and idler rollers 80, 82 continue pulling sheet 48 from media cassette 44 and driving sheet 48 along curved guide plate 90, leading edge 62 rides over idler wheels 98 and onto paddles 112 of moveable media guide 34, with the force of sheet 48 pushing media guide 34 to the open position. According to one embodiment, when in the open position, the tips of paddles 112 extend through corresponding openings in guide plate 94, as indicated at 113.

With reference to FIG. 5E, as drive and idler rollers 80, 82 continue driving sheet 48, leading edge 62 rides along paddles 112, transitions to guide plate 94, rides of idler wheels 102, and is directed to exposure system 38. Exposure roller 70 is then driven in a direction as indicated by directional arrow 79*a*, and leading edge 62 of sheet 48 is engaged and drawn into a nip formed by exposure roller 70 and first pressure roller 72. Sheet 48 is then driven between exposure roller 70 and first and second pressure rollers 72, 74, and laser scanning module 76 begins forming a latent image on sheet 48 via light beam 78 which is modulated based on image data (e.g. digital image data). Sheet 48 continues to hold paddles 112 of moveable media guide 34 in the open position. Also, as exposure roller 70 continues to drive sheet 48 through laser exposure system 38, sheet 48 transitions from traveling along guide plate 94 to traveling on a surface of stationary idler wheels 100, which rotate as sheet 48 passes and reduces the potential for disturbances to sheet 48 which might otherwise occur if sheet 48 was sliding on guide plate 94, thereby reducing the occurrence of errors in the latent image formed on sheet 48 by laser scanning module 76. According to one embodiment, after sheet 48 is engaged by exposure roller 70 and first pressure roller 72, but before imaging of sheet 48 by laser scanning module 76, sheet 48 is disengaged by drive and idler rollers 80, 82 of feeder assembly 32.

Figure 5F:
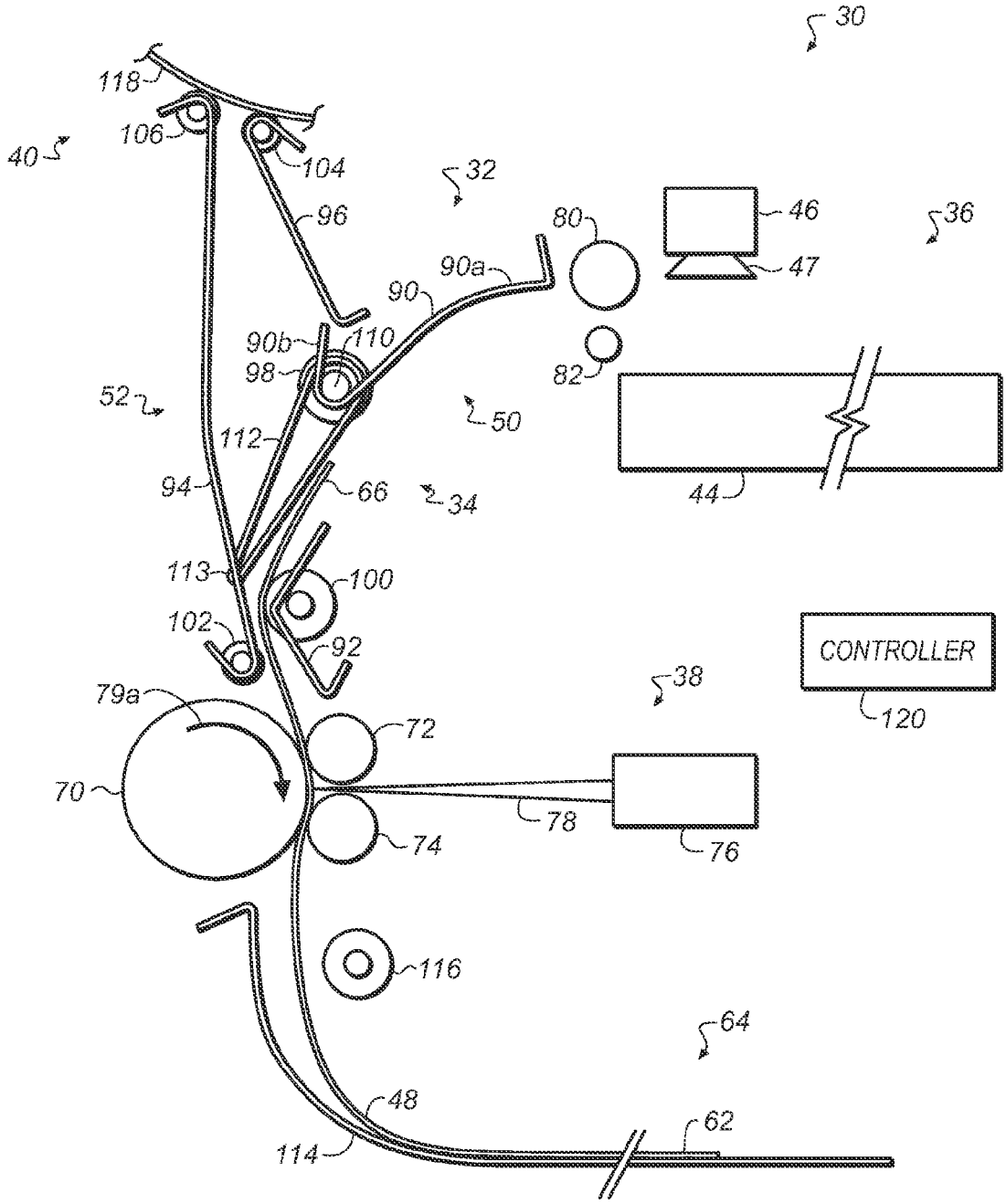

With reference to FIG. 5F, as exposure roller 70 continues to rotate and drive sheet 48 past modulated light beam 78 provided by laser scanning module 76, exposed portions of sheet 48 travel along and are collected by guide plate 114 of accumulator 64, and trailing edge 66 of sheet 48 is extracted from media cassette 44 and begins traveling along guide plate 90. Eventually, trailing edge 66 transitions from guide plate 90 onto paddles 112, via idler wheels 98, with trailing edge 66 continuing to maintain moveable media guide 34 in the open position.

Figure 5G:
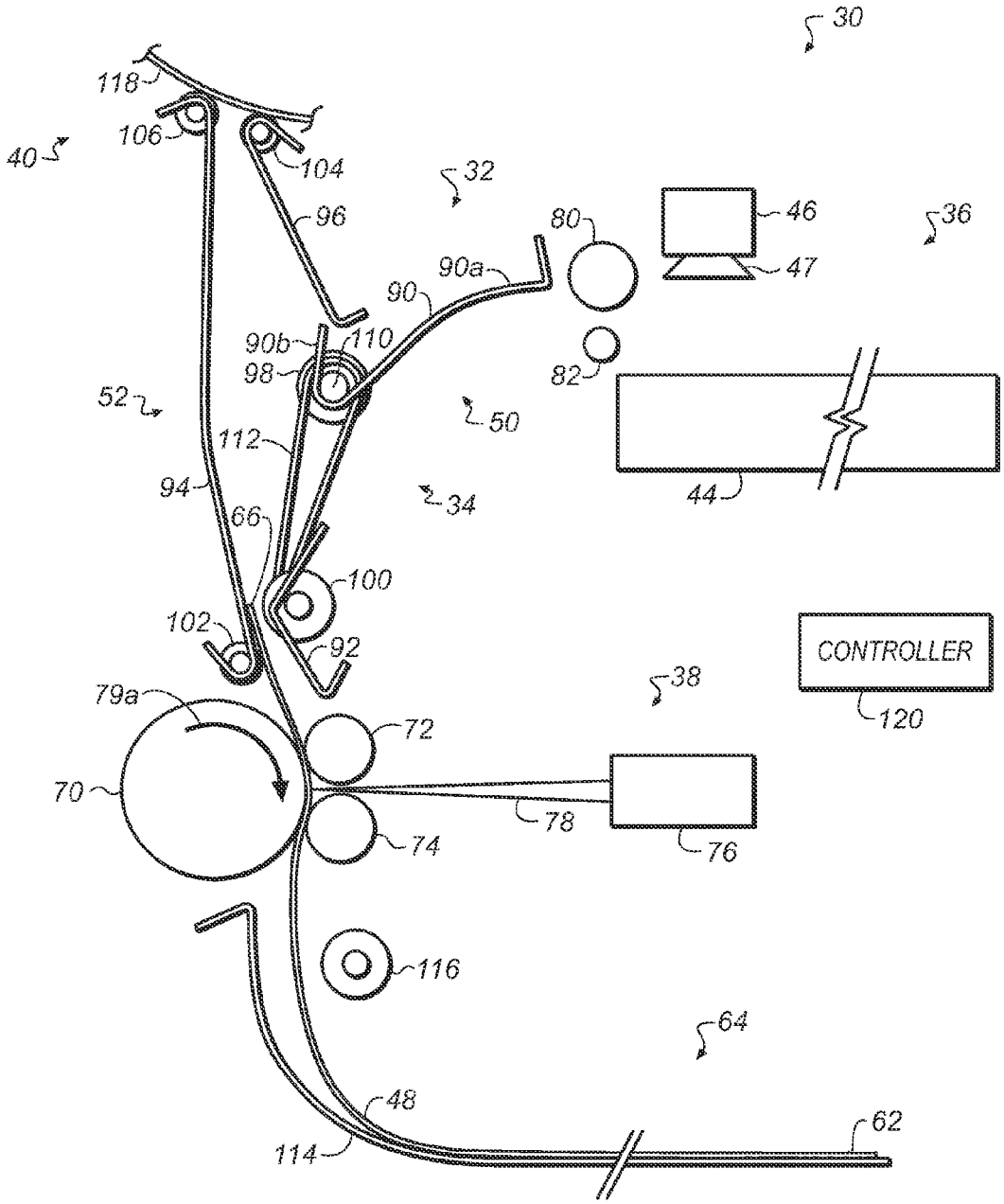

With reference to FIG. 5G, as exposure roller 70 continues to rotate, sheet 48 continues to be driven past and exposed by modulated light beam 78 of laser scanning module 76. Ultimately, trailing edge 66 of sheet 48 rides along is transitioned from supply path 50 to guide plate 94 of transport path 52 by paddles 112 of moveable media guide 34. As soon as trailing edge 66 transitions from paddles 112 to guide plate 94, paddles 112 are no longer held in the open position by sheet 48 and paddles 112 moveable media guide 34 return to the normally closed position by the force of gravity, thereby blocking off supply path 50 from transport path 52.

By providing trailing edge 66 of sheet 48 with a continuous surface on which to ride as it transitions from supply path 50 to transport path 52, paddles 112 of moveable media guide 34 prevent a "whip-like" effect of trailing edge 66 when transitioning from supply path 50 to transport path 52 which would otherwise occur in the absence of paddles 112 due to the elastic nature of the material of sheet 48. By preventing this "whip-like" transition, paddles 112 of moveable media guide 34 eliminate a force that would otherwise be imparted to sheet 48 from such a transition and which would propagate through sheet 48 and cause an error in the latent image being exposed on sheet 48 by laser scanning module 76.

Figure 5H:
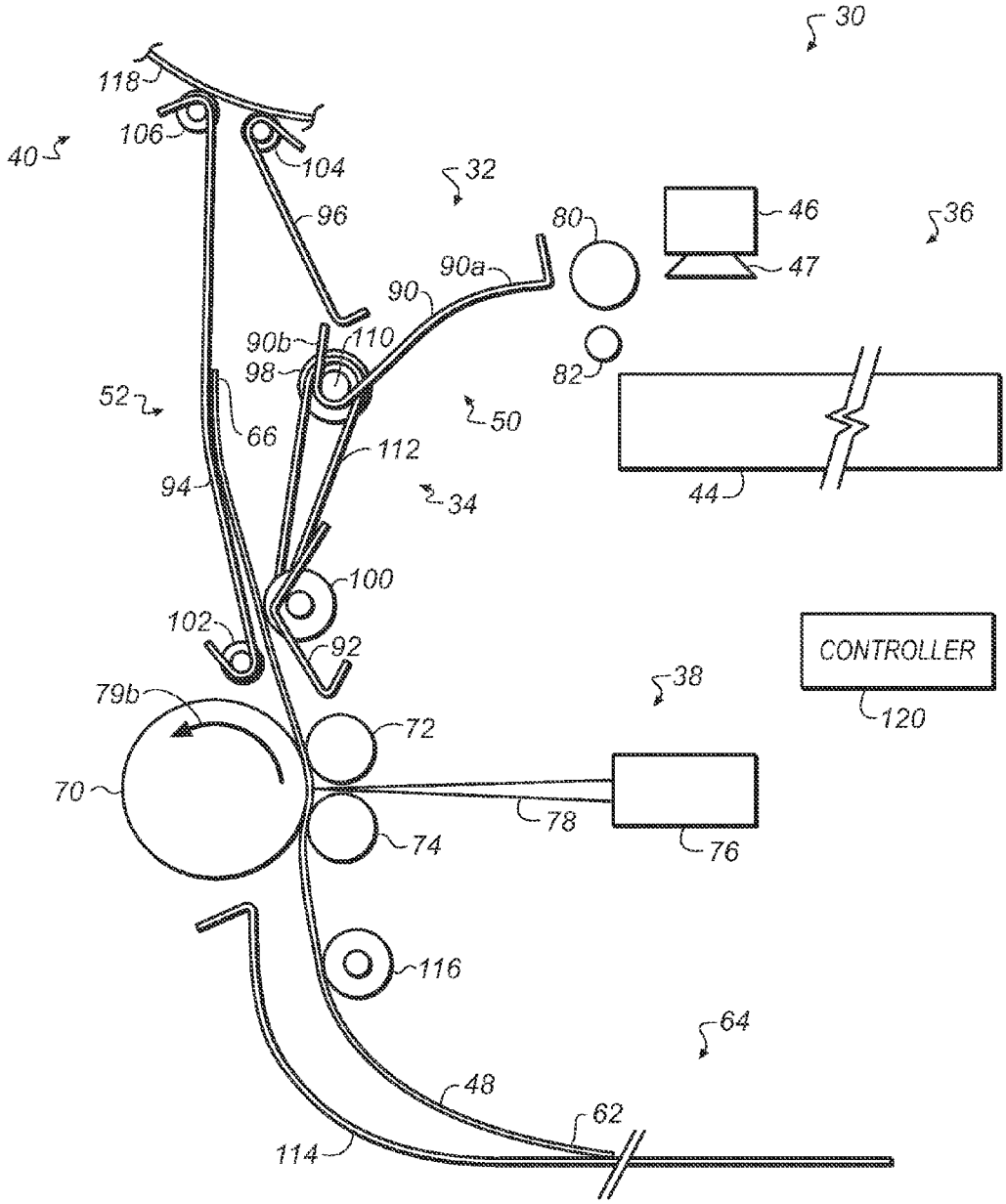

With reference to FIG. 5H, eventually, scanning of sheet 48 via laser scanning module 76 is complete, and exposure roller 70 is driven in the opposite direction, as indicated by directional arrow 79*b*, thereby driving sheet 48 toward along transport path 52 toward processing system 40 such that formerly trailing edge 66 of exposed sheet 48 now becomes the leading edge. With paddles 112 now in the closed position, moveable media guide 34 prevents any potential misfeed of exposed sheet 48 onto supply path 50. Exposure roller 70 of exposure system 38 continues to drive exposed sheet 48 along guide plate 94 of transport path 52 until the now-leading edge 66 is engaged by heated drum 118 of processing system 40, with sheet 48 riding on idler wheels 116 as it is drawn from accumulator 64.

In summary, by using a moveable media guide, the moveable media guide provides continuous support to the sheet of media and prevents a "whip-like" effect of a trailing edge of the sheet of media when transitioning from the supply path to the transport path and thereby eliminates a force that would otherwise be imparted to sheet of media which would propagate through the sheet and cause an error in a latent image being exposed on the sheet by the imaging apparatus. Additionally, by returning to a normally closed position after the sheet of media has transitioned to the transport path from the supply path, the moveable media guide prevents misfeeds of the sheet of media from the transport path to the supply path. Furthermore, by using the sheet of media to push the moveable media guide from the normally closed position to the open position and using gravity to return the moveable media guide to the normally closed position, the need for additional components to drive the moveable media guide between the normally closed and open positions can be eliminated.

A computer program product may include one or more storage medium, for example; magnetic storage media such as magnetic disk (such as a floppy disk) or magnetic tape; optical storage media such as optical disk, optical tape, or machine readable bar code; solid-state electronic storage devices such as random access memory (RAM), or read-only memory (ROM); or any other physical device or media employed to store a computer program having instructions for controlling one or more computers to practice the method according to the present invention.

The invention has been described in detail with particular reference to a presently preferred embodiment, but it will be understood that variations and modifications can be effected within the spirit and scope of the invention. The presently disclosed embodiments are therefore considered in all respects to be illustrative and not restrictive. The scope of the invention is indicated by the appended claims, and all changes that come within the meaning and range of equivalents thereof are intended to be embraced therein.

What is claimed is:

1. An imaging apparatus comprising:

a media supply;

a transport path;

a supply path for transporting sheets of photothermographic imaging media from the media supply to the transport path;

a drive roller driving sheets of photothermographic imaging media along the supply path; and a moveable media guide positioned at a junction of the supply path with the transport path, wherein the media guide is moveable from a normally closed position to an open position to provide a continuous surface for moving a sheet of photothermographic imaging media from the supply path onto the transport path in a first direction along the transport path, and wherein the media guide is moveable from the open position to the normally closed position upon the entire sheet of photothermographic imaging media being moved onto the transport path to block the sheet of photothermographic imaging media from entering the supply path when moving along the transport path in a direction opposite the first direction.

2. The imaging apparatus of claim 1, wherein the moveable media guide is moved to and held in the open position by force of the sheet of photothermographic imaging media being driven along and passing from the supply path to the transport path, and wherein the moveable media guide returns to the normally closed position by the force of gravity upon a trailing edge of the sheet of photothermographic imaging media passing from the moveable media guide onto the transport path.

3. The imaging apparatus of claim 2, wherein the moveable media guide comprises a plurality of elongated paddles, each paddle separately mounted to and independently rotatable about a stationary shaft, wherein the elongated paddles hang from the shaft by gravity in the normally closed position, and wherein the elongated paddles rotate about the shaft to the open position.

4. The imaging apparatus of claim 3, wherein the elongated paddles are spaced apart from one another along the shaft so as to provide support for a plurality of widths of sheets of photothermographic imaging media.

5. The imaging apparatus of claim 3, wherein tips of each of the plurality of elongated paddles extend through corresponding openings in a guide plate of the transport path when the moveable media guide is in the open position.

6. The imaging apparatus of claim 3, wherein a plurality of idler wheels are mounted to the stationary shaft, at least one idler wheel proximate to each of the elongated paddles, each idler wheel independently rotatable about the stationary shaft and configured to transfer the sheet of photothermographic imaging media from the supply path onto the elongated paddles.

7. The imaging apparatus of claim 2, wherein the transport path is substantially vertical and the supply path is off-vertical.

8. The imaging apparatus of claim 1, wherein the moveable media guide comprises plastic.

9. The imaging apparatus of claim 1, wherein the moveable media guide comprises an anti-static acetal material.

10. The imaging apparatus of claim 1, wherein the moveable media guide is moved between the normally closed and open positions by a motor.

11. A method of transporting film in an imaging apparatus, the method comprising:

positioning a moveable media guide at a junction of a supply path with a transport path;

driving a sheet of film from a media source along the supply path to the transport path;

moving the media guide from a normally closed position to an open position to provide a continuous surface for moving the sheet of film from the supply path onto the transport path in a first direction along the transport path; and moving the media guide from the open position to the normally closed position upon the entire sheet of photothermographic imaging media being moved onto the transport path to block the sheet of photothermographic imaging media from entering the supply path when moving along the transport path in a direction opposite the first direction.

12. The method of claim 11, wherein moving the media guide to the open position comprises pushing the media guide to the open position by force of the sheet being driven along the supply path to the transport path, and moving the media guide to the closed position comprising returning the media guide to the closed position by gravity after a trailing edge of the sheet passes from the media guide to the transport path.

13. The method of claim 11, wherein moving the media guide between the normally closed and open positions comprises moving the media guide with a motor.

14. The method of claim 11, including transferring the sheet of film from the supply path onto the media guide via a plurality of idler wheels positioned at an end of the supply path proximate the media guide.

15. An imaging apparatus comprising:

a transport path;

a supply path transporting sheets of media from a media supply to the transport path; and a media guide disposed at a junction of the supply path with the media path and moveable between a normally closed position and an open position, wherein the media guide, when in the open position, provides a continuous surface for supporting a sheet of media being transported along the supply path and being transferred from the supply path onto the transport path in a first direction along the transport path, and when in the closed position, blocks the sheet of media from entering the supply path when being transported along the transport path in a direction opposite the first direction.

16. The imaging apparatus of claim 15, wherein the media guide is maintained in the normally closed position by the force of gravity.

17. The imaging apparatus of claim 15, wherein the media guide is pushed from the normally closed position to the open position by the sheet of media as it is driven along the supply path to the transport path, and wherein the media guide returns to the normally closed position by gravity upon a trailing edge of the sheet of media moves from the media guide to the transport path.

18. The imaging apparatus of claim 15, wherein the media guide comprises a plurality of elongated paddles which a mounted on a shaft and wherein each of the elongated paddles independently rotates about the shaft.

19. The imaging apparatus of claim 15, wherein the media guide comprises an anti-static acetal material.

20. The imaging apparatus of claim 15, wherein the sheets of media comprise photothermographic imaging media.

* * * * *